US005303514A

United States Patent [19]

Oishibashi et al.

[11] Patent Number: 5,303,514

[45] Date of Patent: Apr. 19, 1994

[54] RAIL GRINDING APPARATUS

[75] Inventors: Hirotsugu Oishibashi, Tokyo; Soji Fujimori; Muneyuki Ohara, both of Musashino; Haruo Yokoyama, Kokubunji; Akihiro Hosokawa, Nishinomiya; Kosuke Nagai; Hideshi Miyazaki, both of Osaka, all of Japan

[73] Assignees: Sumikin Osaka Plant Engineering Co., Ltd., Osaka; Railway Technical Research Institute, Tokyo; Sumitomo Metal Technology Inc., Hyogo, all of Japan

[21] Appl. No.: 99,393

[22] Filed: Jul. 30, 1993

Related U.S. Application Data

[63] Continuation of Ser. No. 917,749, Jul. 24, 1992, abandoned, which is a continuation of Ser. No. 457,077, Dec. 26, 1989, abandoned.

[30] Foreign Application Priority Data

Dec. 27, 1988 [JP] Japan ..... 63-169592[U]

[51] Int. Cl.[5] ..... B24B 23/00; B24B 19/00

[52] U.S. Cl. ..... 51/178; 51/24 KG; 51/170 EB

[58] Field of Search ..... 51/178, 241 LG, 170 EB, 51/241 S

[56] References Cited

U.S. PATENT DOCUMENTS

| | | | |
|---|---|---|---|
| 2,096,424 | 10/1937 | Cooney et al. . | |
| 3,129,535 | 4/1964 | Slattery | 51/178 X |
| 3,154,892 | 11/1964 | Kruger | 51/178 |
| 3,417,511 | 12/1968 | Dudek et al. . | |
| 3,707,808 | 1/1973 | Danko | 51/178 |
| 4,178,723 | 12/1979 | Fleckenstein | 51/174 X |

FOREIGN PATENT DOCUMENTS

| | | |
|---|---|---|
| 1154496 | 9/1963 | Fed. Rep. of Germany . |
| 0817826 | 8/1959 | United Kingdom . |

*Primary Examiner*—M. Rachuba

*Attorney, Agent, or Firm*—Sughrue, Mion, Zinn, Macpeak & Seas

[57] ABSTRACT

A rail grinding apparatus for railroad rails has a grinding belt wrapped around motor-driven pulleys which are rotatably mounted on a frame. The frame is supported on the surface of a rail by rollers which bear the weight of the grinding apparatus. A noise guard surrounds the grinding belt to reduce noise.

9 Claims, 2 Drawing Sheets

RAIL GRINDING APPARATUS

This is a continuation of application No. 07/917,749 filed Jul. 24, 1991, now abandoned which is a continuation of application Ser. No. 07/457,077 filed Dec. 26, 1989 now abandoned.

BACKGROUND OF THE INVENTION

This invention relates to a rail grinding apparatus for grinding the welded joints of railroad rails. More particularly, it relates to a rail grinding apparatus which does not require the exertion of any significant force by the operator of the apparatus.

The rails of modern railroads are usually connected with one another by butt welding. Various butt welding methods are employed, including gas pressure welding, flash butt welding, thermit welding, and enclosed arc welding. FIG. 1 is a side view of two rails 1 which have been connected by conventional butt welding, and FIG. 2 is a cross-sectional view taken along Line II—II of FIG. 1. As shown in these figures, a weld bead is formed around the entire periphery of the joint between the two rails 1. The weld bead extends considerably above the surface of the rails 1, so it must be removed by grinding. Conventionally, the weld bead is removed from the weld joint using a hand grinder. A surface hand grinder is used to grind the top surface 12, while common hand grinders are used to grind the gage corner surfaces 13 and the upper lateral surfaces 14 of the rails 1. Two different types of grinders must be used. These grinders are hereunder collectively referred to merely as "hand grinders".

Furthermore, the contact force between a hand grinder and the surface of the rails 1 must be exerted by the operator of the hand grinder. As it is difficult for an operator to exert a steady contact force, hand grinding often produces irregularities in the surface of the rails 1, and it is difficult to obtain a finished surface having the required surface tolerance of $-0.1-+0.3$ mm/m. Hand grinding also produces an unpleasant shrill noise, which is objectionable from the standpoint of both the operator of the hand grinder and others working nearby. Furthermore, a hand grinder generates vibrations which are not only fatiguing to an operator and prevent him from working for long periods but which also may cause the operator to develop medical problems, such as Raynaud's phenomenon.

SUMMARY OF THE INVENTION

Accordingly, it is an object of the present invention to provide a rail grinding apparatus for railroads rails which can grind the surface of a rail without an operator having to exert any significant force.

It is another object of the present invention to provide a rail grinding apparatus which can provide a uniform finished surface.

It is yet another object of the present invention to provide a rail grinding apparatus which produces little noise.

It is a further object of the present invention to provide a rail grinding apparatus which imparts little vibration to the hands of an operator.

A rail grinding apparatus according to the present invention has a frame equipped with rolling support members, such as rollers or wheels, which support the frame while rolling along the surface of a rail. A rotary grinding device, such as a motor-driven grinding belt or a grinding wheel, is mounted on the frame such that the grinding device can grind the surface of a rail when the rolling support members are resting on the rail. The rolling support member carry all or substantially all of the weight of the grinding apparatus, and the force of contact between the grinding device and the rail is produced by the weight of the grinding apparatus. The grinding apparatus can be rolled along a rail by being lightly pushed by an operator, and the operator does not have to exert any significant force on the grinding apparatus during operation. The grinding device may be surrounded by a guard which protects the operator and reduces the level of noise generated by the grinding apparatus.

DESCRIPTION OF THE PREFERRED EMBODIMENT

Figure 1:
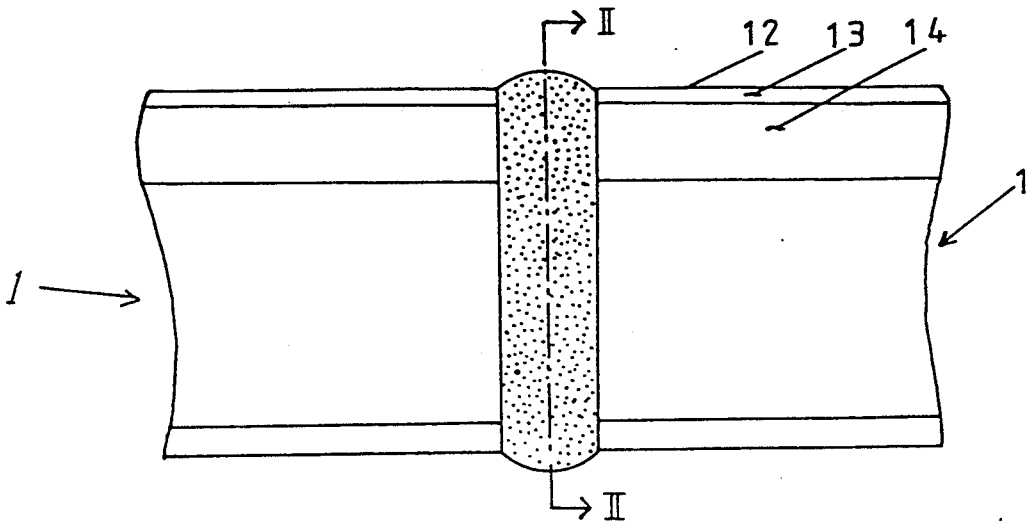
FIG. 1 is an elevation of a pair of railroad rails which have been connected by butt welding.
Figure 2:
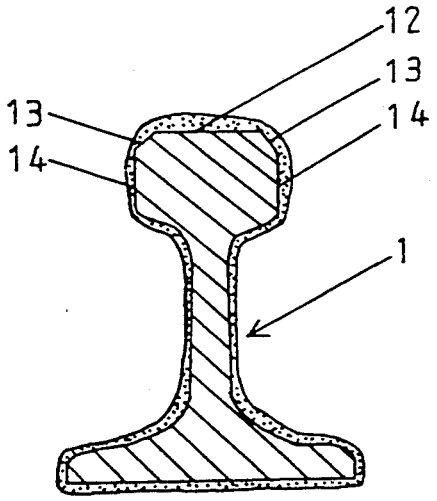
FIG. 2 is a cross-sectional view taken along Line II—II of FIG. 1.
Figure 3:
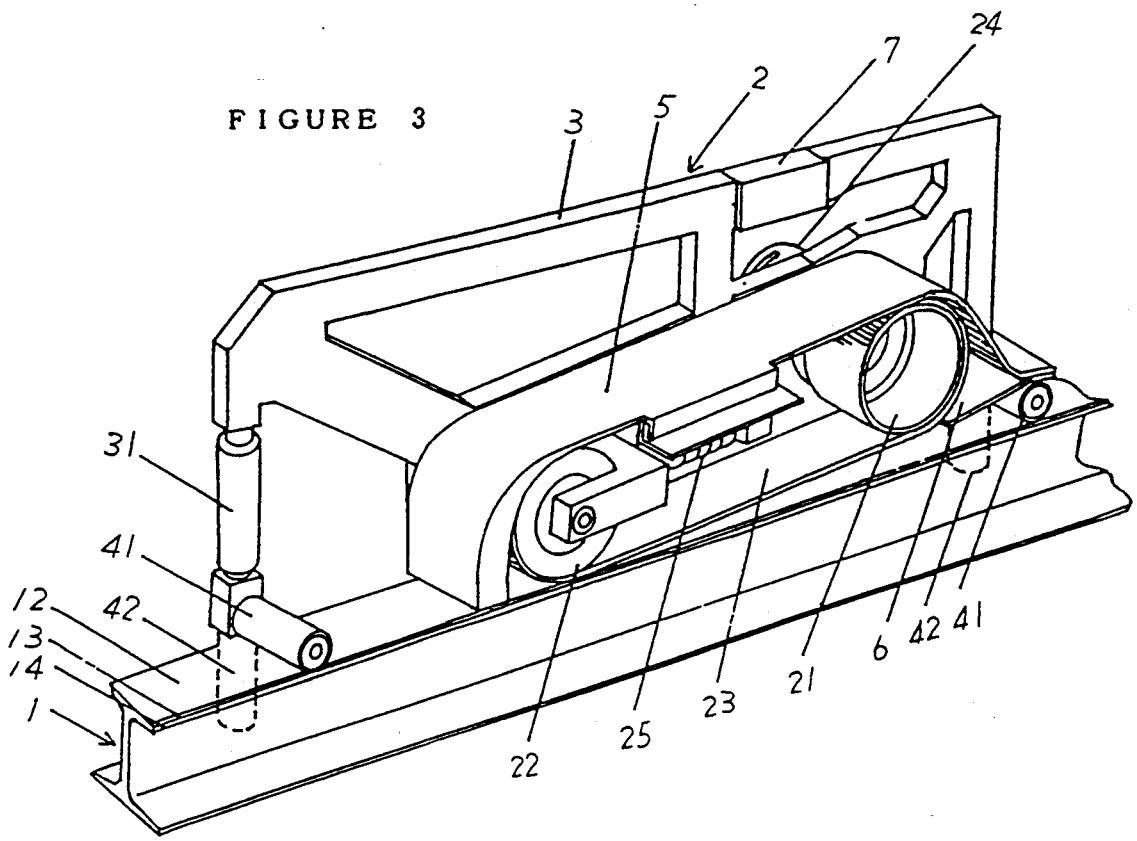
FIG. 3 is a perspective view of an embodiment of a rail grinding apparatus according to the present invention when grinding the top surface of a rail.

A preferred embodiment of a rail grinding apparatus according to the present invention will now be described while referring to the accompanying drawings. FIG. 3 illustrates this embodiment when grinding the top surface 12 of a rail 1. The rail grinding apparatus, which is indicated by reference numeral 2, has a support frame 3 which may have a number of openings formed therein to enable it to be easily grasped by an operator. Rotating support members in the form of first and second rollers 41 and 42 are rotatably mounted on the lower portions of the front end (the left end in FIG. 3) and the rear end of the frame 3. The first rollers 41 extend perpendicularly from the frame 3, while the second rollers 42 extend downwards in the plane of the frame 3. As shown in FIG. 3, when grinding the top surface 12 of a rail 1, the first rollers 41 sit on the surface 12 of the rail 1 and support the weight of the grinding apparatus 2, while the second rollers 42 contact the upper lateral surfaces 14 of the rail 1. The front end of the frame 3 includes an adjusting screw 31 which enables the height of the front end to be adjusted.

A rotary grinding device in the form of a grinding belt 23 is wrapped around a pair of pulleys 21 and 22 which are rotatably mounted on the frame 3. The pulleys 21 and 22 extend perpendicularly from the frame 3 parallel to the first rollers 41. The front pulley 22 is preferably made of an elastic material such as rubber so that the grinding belt 23 will be resilliently pressed against the rail 1 by the pulley 22. The rear pulley 21 is rotated by an electric motor 24 which is mounted on the frame 3, and the rotation of the rear pulley 21 is transmitted to the front pulley 22 by the grinding belt 23. The tension in the grinding belt 23 can be adjusted by a conventional tensioning mechanism 25 which is secured to the frame 3. The motor 24 can be controlled by a switch box 7 which is incorporated into the upper portion of the frame 3.

The pulleys 21 and 22 and the grinding belt 23 are covered by a protective cover 5 which prevents clothing and other items from becoming caught in the pulleys 21 and 22 and also protects the operator from grinding sparks. The cover 5 can also greatly reduce the level of noise which is generated by the grinding apparatus. A guard plate 6 is secured to the underside of the protective cover 5 just to the rear of the rear pulley 21 to protect the rear rollers 41 and 42 from grinding sparks.

The force of contact between the grinding belt 23 and the rail 1 can be adjusted by the adjusting screw 31. As this force is provided by the weight of the grinding apparatus 2, which is constant, grinding can be performed with a uniform grinding force, so a uniform surface finish can be obtained.

When grinding the top surface 12 of a rail 1, the operator rolls the grinding apparatus 2 along the rail 1 to a welded joint. When rolling the grinding apparatus 2 from joint to joint, it may be desirable to adjust the adjusting screw 31 so that the grinding belt 23 is completely separated from the surface of the rail 1 to reduce frictional resistance. When the weld joint to be subjected to grinding is reached, the adjusting screw 31 is adjusted to produce a suitable contact force between the grinding belt 23 and the rail 1. The operator then turns on the motor 24 to rotate the grinding belt 23. While the grinding belt 23 is turning, the operator may want to move the frame 3 in the lengthwise direction of the rail 1 back and forth over the joint. When the first rollers 41 are rolling on the top surface 12 of a rail 1, the second rollers 42 act as guide rollers and help the operator to keep the grinding apparatus 2 atop the rail 1. As the weight of the grinding apparatus 2 is entirely supported by the first rollers 41 and the grinding force is provided by the weight of the grinding apparatus 2, the operator has to exert very little force on the grinding apparatus 2 and is not subjected to harmful vibrations.

Figure 4:
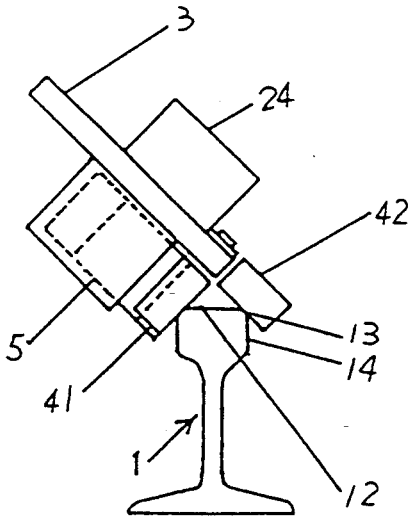
FIG. 4 is an end view of the rail grinding apparatus of FIG. 3 when grinding the gage corner surface of a rail.

When grinding the gage corner surfaces 13 of a rail 1, the frame 3 is tilted as shown in FIG. 4 so that the first and second rollers 41 and 42 rest on the gage corner surfaces 13 on opposite sides of the rail 1. In this attitude, the motor 24 is turned on to grind the gage corner surface 13 on which the first roller 41 is resting. When it is desired to grind the gage corner surface 13 on the other side of the rail 1, the grinding apparatus 2 is repositioned so that the first rollers 41 rest on the other side.

Figure 5:
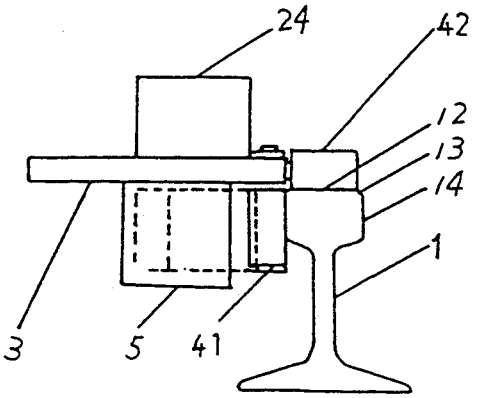
FIG. 5 is an end view of the rail grinding apparatus of FIG. 3 when grinding the upper lateral surface of a rail.

When grinding the upper lateral surface 14 of a rail, the frame 3 is tilted until it is horizontal as shown in FIG. 5. In this state, the first rollers 41 contact the upper lateral surface 14 which is to be subjected to grinding, and the second rollers 42 rest on the top surface 12 of the rail.

What is claimed is:

1. A rail grinding apparatus comprising:

a frame;

a rotary grinding device mounted on the frame for grinding rail surfaces in grinding planes corresponding to the top, gage corner, and upper lateral surfaces of the rail;

first rollers rotatably mounted on the frame for rotation about first axes lying in a first plane parallel to the grinding plane to support the frame on a rail;

second rollers rotatably mounted on the frame for rotation about second axes extending transversely with respect to the first axes, wherein the first and second axes are stationary relative to one another;

means for adjusting the distance of the rotary grinding device from the first plane; and the first rollers and the second rollers are placed in such an arrangement that the frame can be tilted around the rail surfaces such that the grinding plane can be positioned to correspond to any one of the planes defined by the top, gage corner, and upper lateral surfaces of the rail in order to grind the top, gage corner, and upper lateral surfaces of the rail.

2. A rail grinding apparatus as claimed in claim 1 wherein the rotary grinding device comprises:

a pair of pulleys which are rotatably mounted on the frame;

a grinding belt which is wrapped around the pulleys; and a motor for rotating the pulleys.

3. A rail grinding apparatus as claimed in claim 2, wherein one of the pulleys is made of an elastic material.

4. A rail grinding apparatus as claimed in claim 3, wherein front pulley by which said grinding belt may be resiliently pressed against a rail to be ground is made of an elastic material.

5. A rail grinding apparatus as claimed in claim 2, wherein said pair of pulleys and said grinding belt are covered by a protective cover.

6. A rail grinding apparatus as claimed in claim 5, wherein a guard plate is secured to the underside of said protective cover.

7. A rail grinding apparatus as claimed in claim 1, further comprising a noise guard which surrounds the rotating grinding device.

8. A rail grinding apparatus as claimed in claim 1 wherein the second axes are perpendicular to the grinding plane.

9. A rail grinding apparatus as claimed in claim 1 wherein the frame includes a handle for enabling the rotary grinding device to be lifted off the surface of a rail while maintaining one of the first rollers in rolling contact with the rail.

* * * * *